United States Patent [19]

Kropiwnicki

[11] 4,396,359

[45] Aug. 2, 1983

[54] MOTOR COMPRESSOR UNIT

[75] Inventor: Tadek M. Kropiwnicki, Syracuse, N.Y.

[73] Assignee: Carrier Corporation, Syracuse, N.Y.

[21] Appl. No.: 284,852

[22] Filed: Jul. 20, 1981

[51] Int. Cl.[3] ..... F04B 39/00

[52] U.S. Cl. ..... 417/312; 62/296; 181/403; 285/162; 285/DIG. 22; 417/371; 417/902

[58] Field of Search ..... 417/312, 313, 902, 363, 417/424, 371; 181/403; 62/296; 285/192, 193, 194, DIG. 22, 162

[56] References Cited

U.S. PATENT DOCUMENTS

| | | | |
|---|---|---|---|
| 1,622,827 | 3/1927 | Hanson | 417/424 |
| 2,514,504 | 7/1950 | Moline | 285/194 X |
| 2,784,987 | 2/1957 | Corcoran . | |
| 3,101,891 | 8/1963 | Frank | 417/312 |
| 3,231,300 | 1/1966 | Moroney | 285/DIG. 22 |
| 3,409,858 | 11/1968 | Krehbiel . | |
| 3,785,584 | 1/1974 | Crellin, Jr. . | |
| 3,858,913 | 1/1976 | Gallagher . | |
| 3,876,339 | 4/1975 | Gannaway | 417/312 |
| 4,099,744 | 7/1978 | Kutnyak . | |
| 4,128,264 | 12/1978 | Oldford . | |
| 4,209,080 | 6/1980 | Douglas . | |
| 4,242,056 | 12/1980 | Dyhr et al. | 417/902 X |

*Primary Examiner*—Edward K. Look

*Attorney, Agent, or Firm*—Donald F. Daley; David J. Zobkiw

[57] ABSTRACT

A motor compressor unit comprising a compressor, a motor, a shell enclosing the compressor and the motor, a motor cap located within the shell, covering a portion of the motor, and defining an attenuation tube opening, and an attenuation tube connected to the motor cap and extending through the attenuation tube opening. The attenuation tube includes a body; first and second lower lips extending outward from the body, below and in pressure contact with an outside surface of the motor cap, first and second alignment flange portions projecting above the first and second lower lips, adjacent opposed surfaces of the motor cap defining the attenuation tube opening; said first and second upper lips extending outward from the body, above and in pressure contact with an inside surface of the motor cap.

7 Claims, 6 Drawing Figures

MOTOR COMPRESSOR UNIT

BACKGROUND OF THE INVENTION

The present invention generally relates to motor compressor units, and more specifically to motor compressor units employing motor caps and motor cap attenuation tubes to dissipate pressure pulses generated within the motor compressor unit.

The utilization of motor compressor units has become increasingly prevalent in recent years, particularly in refrigeration applications where the motor compressor unit is employed to compress refrigerant vapor. Conventionally, the motor compressor unit includes a compressor, a motor such as an electric motor, and a shell enclosing both the compressor and the motor. Typically, the compressor defines one or more cylinder chambers, a suction plenum which guides vapor to the cylinder chambers, and a discharge plenum which receives vapor from the cylinder chambers. A suction valve is positioned between the suction plenum and each cylinder chamber to control vapor flow therebetween, and a discharge valve is located between each cylinder chamber and the discharge plenum to regulate vapor flow therebetween. A reciprocable piston is movably disposed within each cylinder chamber, and the compressor also includes a rotatable crankshaft connected to both the motor and the compressor pistons.

In operation, low pressure vapor is drawn into the shell and through the motor to cool the motor. The vapor is then conducted into the compressor, specifically the suction plenum thereof. At the same time, the motor drives or rotates the compressor crankshaft, while rotation of the crankshaft reciprocates the pistons within the cylinder chambers. Reciprocating movement of the pistons within the cylinder chambers draws vapor thereinto from the suction plenum, compresses vapor within the cylinder chambers, and then discharges the compressed vapor into the discharge plenum. Therefrom the compressed vapor is conducted from the compressor and from the shell via a vapor discharge line. As is well understood in the art, the suction and discharge valves cyclically open and close to permit vapor flow from the suction plenum into the cylinder chambers and from the cylinder chambers into the discharge plenum.

This cyclic opening and closing of the suction valves, as is known by those skilled in the art, generates pressure pulses in the vapor flow path leading to the suction valves. These pressure pulses may be transmitted along the vapor flow path to the shell of the motor compressor unit, and the shell may transmit the pressure pulses to the ambient, producing undesirable noise. In order to dissipate these pressure pulses and to prevent the concomitant noise, a motor cap and a motor cap attenuation tube are often employed with motor compressor units of the general type described above. The motor cap is secured to and covers the top of the motor, and defines a small opening to allow vapor to flow into the motor cap and thence through the motor and to the compressor. The attenuation tube fits within the opening defined by the motor cap and extends outward therefrom to guide vapor into the motor cap. The motor cap and motor cap attenuation tube diffuse the pressure pulses developed by the suction valves, substantially reducing any noise generated thereby. Before the present invention, these attenuation tubes have been formed from a metal and then welded to the motor caps, which have also been made from metal. While these attenuation tubes perform very satisfactorily, they have a number of disadvantages; principally cost. The raw material for the tubes and the process of forming the tubes are both costly, and welding the attenuation tubes to the motor caps requires a considerable amount of time and skilled labor. Moreover, a metal attenuation tube, being a good conductor of heat, conducts heat from the motor cap to the vapor flowing through the attenuation tube, heating that vapor. This may have a slight adverse affect on the performance of the motor compressor unit. Further, the attenuation tubes previously used, in order to keep the manufacture of the tubes simple, have a uniform cross sectional shape, defining a vapor flow path of uniform cross sectional area. As vapor is drawn through this uniform area flow path, from the relatively large volume within the shell to the much smaller volume within the motor cap, some turbulence may develop in the attenuation tube. This turbulence may decrease the pressure of the vapor passing through the attenuation tube, also adversely affecting operation of the motor compressor unit.

SUMMARY OF THE INVENTION

In view of the above, an object of the present invention is to provide a reduced cost attenuation tube for a motor cap of a motor compressor unit.

Another object of this invention is to provide a plastic attenuation tube which can be aligned within a tube slot defined by a motor cap of a motor compressor unit, connected to the motor cap, and removed therefrom using very simple, quick, and inexpensive procedures.

Still another object of the present invention is to maintain a plastic attenuation tube secured to a motor cap of a motor compressor unit without significant stress on the attenuation tube itself.

A further object of this invention is to provide a plastic attenuation tube which may be connected to and disconnected from a motor cap of a motor compressor unit from the outside of the motor cap.

Another object of the present invention is to reduce pressure losses within an attenuation tube, which conducts vapor into a motor cap of a motor compressor unit.

These and other objects are attained with a motor compressor unit comprising a compressor, a motor connected to the compressor to drive the compressor, a shell enclosing the compressor and the motor, a motor cap located within the shell, secured to and covering a portion of the motor, and defining an attenuation tube opening, and an attenuation tube connected to the motor cap and extending through the attenuation tube opening. The attenuation tube includes a body having a front side and defining a pair of spaced, front slits extending downward from a top of the front side of the body to form a front, flexible body section; first and second lower lips extending outward from the body, below and in pressure contact with an outside surface of the motor cap; first and second alignment flange portions projecting above the first and second lower lips adjacent opposed surfaces of the motor cap defining the attenuation tube opening; and first and second upper lips extending outward from the body, above and in pressure contact with an inside surface of the motor cap.

A selected one of the first and second upper lips extends outward from the front, flexible body section.

Also, a selected one of the first and second upper lips includes a bottom section extending outward from the body, in pressure contact with the inside surface of the motor cap, and defining a beveled surface sloping upward and outward to facilitate moving the bottom section into pressure contact with the inside surface of the motor cap; and a top section extending outward from the body and upward from the bottom section, and defining a beveled surface sloping upward and inward to assist inserting the attenuation tube into the attenuation tube opening.

A DETAILED DESCRIPTION OF THE PREFERRED EMBODIMENT

Figure 1:
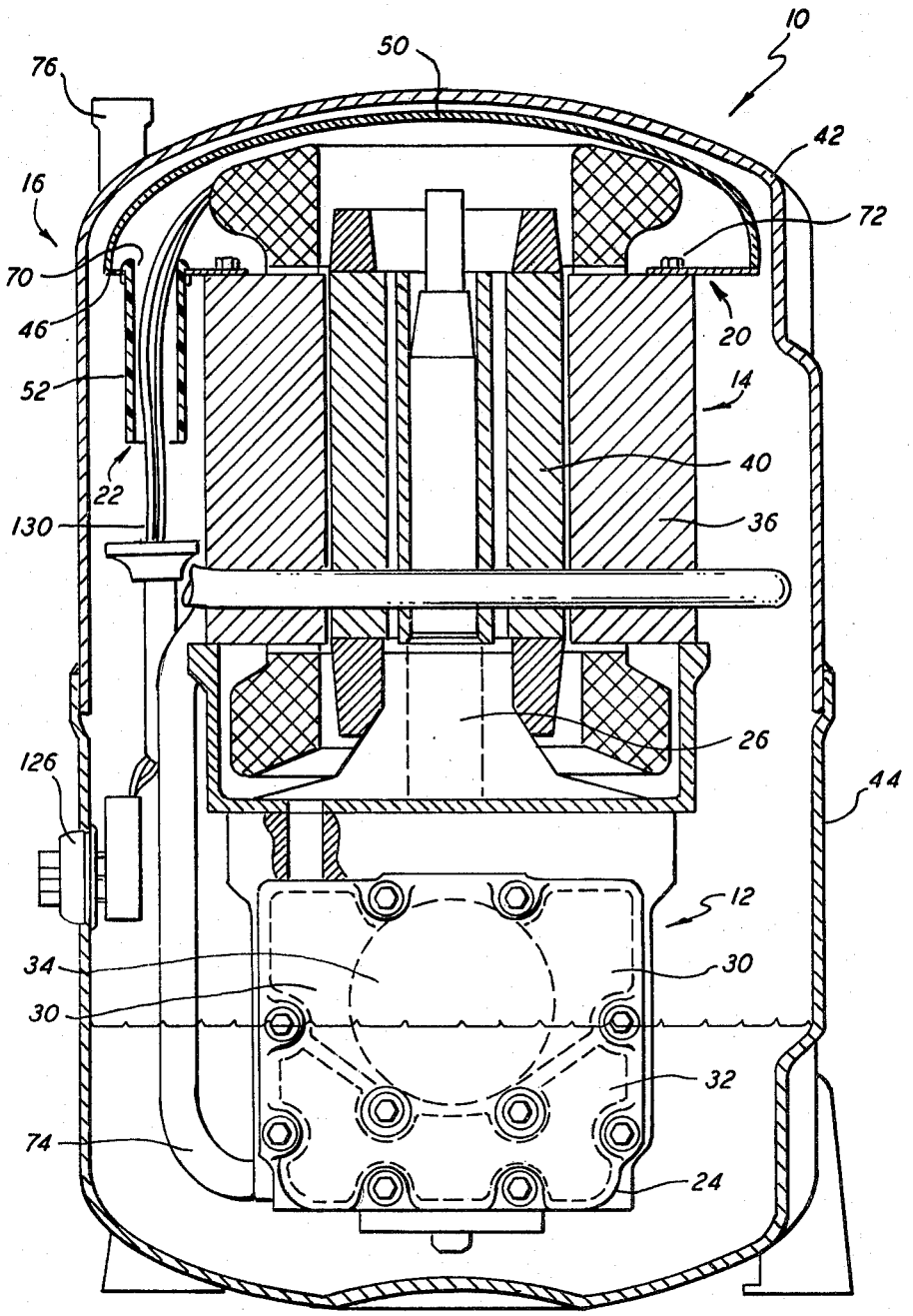
FIG. 1 is a side view, partially in cross section, of a motor compressor unit constructed in accordance with a preferred embodiment of the present invention.
Figure 2:
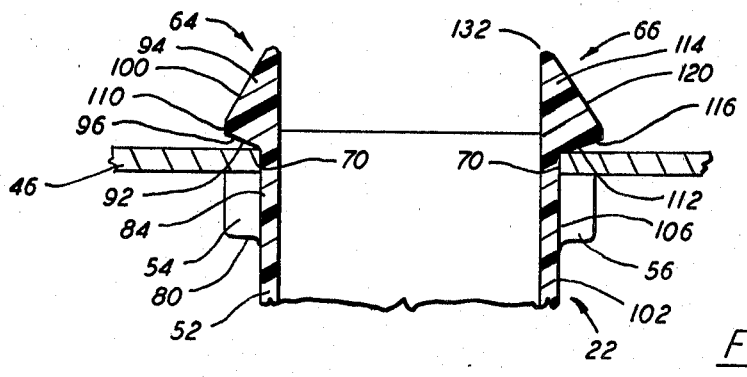
FIG. 2 is an enlarged view of a part of FIG. 1, illustrating in greater detail the upper portion of the motor cap attenuation tube shown in FIG. 1.
Figure 3:
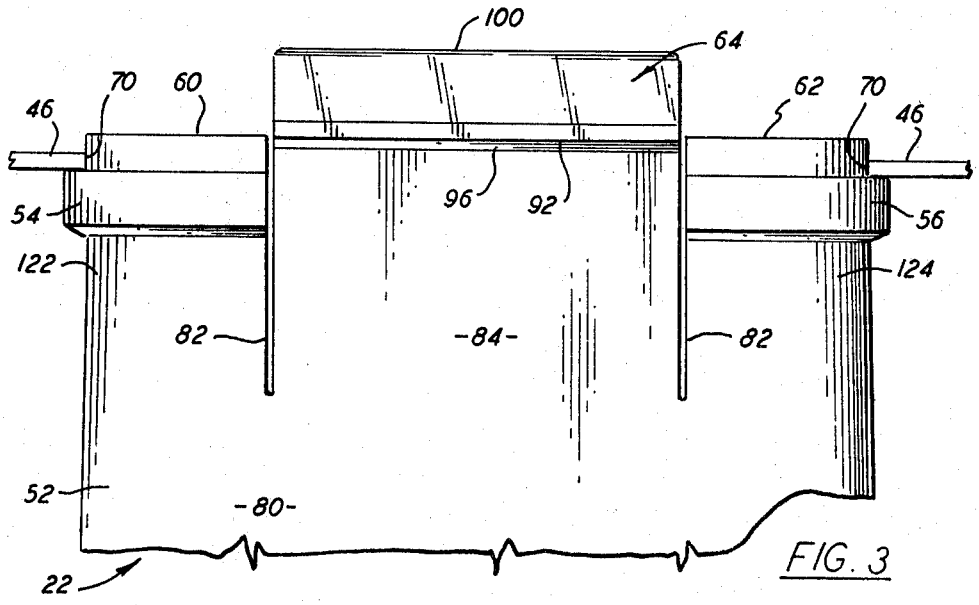
FIGS. 3 and 4 are enlarged, partial front and side views of the attenuation tube.
Figure 4:
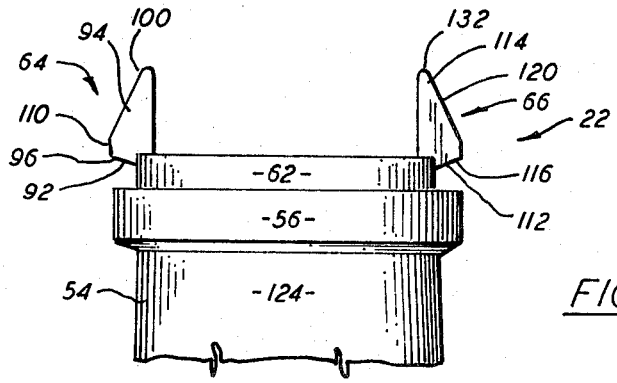
Figure 5:
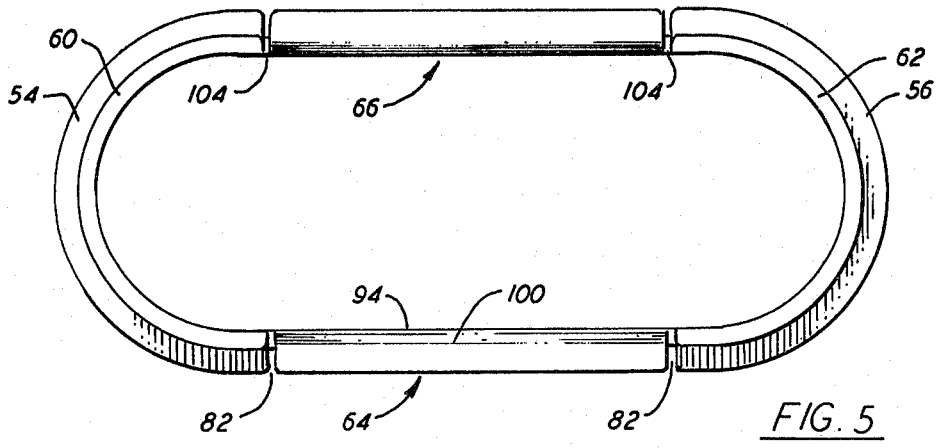
FIG. 5 is an enlarged, top view of the attenuation tube.
Figure 6:
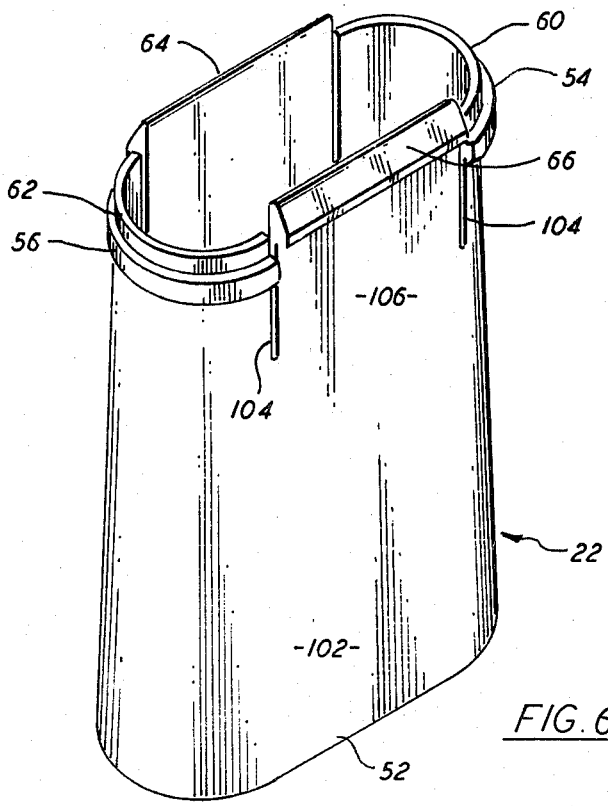
FIG. 6 is a perspective view of the attenuation tube.

Particularly referring to FIG. 1, there is disclosed motor compressor unit 10 constructed in accordance with a preferred embodiment of the present invention. Unit 10 generally includes compressor 12, motor such as electric motor 14, shell 16, motor cap 20, and attenuation tube 22. More particularly, compressor 12 includes cylinder block 24, one or more pistons (not shown), and crankshaft 26; and the cylinder block defines suction plenum 30, discharge plenum 32, and one or more cylinder chambers 34. Motor 14 includes stator 36 and rotor 40, shell 16 includes top and bottom halves or sections 42 and 44, and motor cap 20 includes bottom base plate 46 and top dome 50. With reference to FIGS. 2 through 6, attenuation tube 22 includes body 52, first and second lower lips 54 and 56, first and second alignment flange portions 60 and 62, and first and second upper lips 64 and 66.

Returning to FIG. 1, in assembly, motor 14 is connected to compressor 12 to drive the compressor. More specifically, motor rotor 40 is secured to compressor crankshaft 26 to rotate the crankshaft. A compressor piston is slidably disposed within each cylinder chamber 34, and the compressor pistons are connected to compressor crankshaft 26, wherein rotation of the crankshaft reciprocates the compressor pistons within cylinder chambers 34. Preferably motor 14 is located above and is supported by compressor 12. Shell 16 encloses compressor 12 and motor 14, and preferably shell sections 42 and 44 are welded together along a horizontal seam to form a hermetically sealed unit. Motor cap 20 is located within shell 16, is secured to and covers a portion of motor 14, and defines attenuation tube opening or slot 70. In particular, motor cap base plate 46, which preferably has a planar, ring shape, is secured to motor stator 36, for example via bolts 72, and extends outward from the stator. Motor cap dome 50, which preferably has the shape of a hollow semisphere, is secured to base plate 46, for example by welding, and extends thereover and over the top of motor 14. Preferably, base plate 46 defines attenuation tube opening 70, which preferably has an oval shape. In a manner more fully explained below, attenuation tube 22 is connected to motor cap 20 and extends through attenuation tube opening 70.

In the preferred operation of motor-compressor unit 10, low pressure vapor is conducted into shell 16 via a shell inlet (not shown). The vapor is drawn through attenuation tube 22, into motor cap 20, and then over and through motor 14, cooling the motor. The vapor is then drawn into cylinder block 24 and into suction plenum 30. At the same time, motor 14 rotates compressor crankshaft 26, and rotation of the crankshaft reciprocates the compressor pistons within cylinder chambers 34. As the compressor pistons reciprocate within cylinder chambers 34, vapor is drawn thereinto from suction plenum 30, compressed within the cylinder chambers, and then discharged into discharge plenum 32. Therefrom, discharge line 74 (only partially shown in FIG. 1) conducts the compressed vapor to shell outlet 76, through which the vapor is discharged from shell 16.

In a conventional manner well understood in the art, suction valves (not shown) are located between suction plenum 30 and cylinder chambers 34 and discharge valves (also not shown) are positioned between the cylinder chambers and discharge plenum 32, and these valves cyclically open and close to permit alternately vapor flow from the suction plenum into the cylinder chambers and from the cylinder chambers into the discharge plenum. As mentioned above, the cyclic opening and closing of the suction valves may generate pressure pulses in the vapor flow path leading to the suction valves. Motor cap 20 and attenuation tube 22 effectively dissipate these pressure pulses, though, preventing the transmission of the pulses from shell 16 to the surrounding area. In accordance with the present invention, attenuation tube 22 may be formed from a plastic material and, inter alia, is particularly well adapted to be connected to and disconnected from motor cap 20 using very simple, quick, and inexpensive procedures.

Discussing attenuation tube 22 in greater detail, referring now to FIGS. 2 through 6, body 52 of the attenuation tube includes front side 80 and defines a pair of spaced, front slits or grooves 82 extending downward from a top of the front side of the body to form a front, flexible body section 84; that is, a section which may be flexed or bent slightly relative to adjacent portions of the attenuation tube body. First and second lower lips 54 and 56 extend outward from body 52, below and in pressure contact with an outside surface of motor cap 20, specifically an outside or bottom surface of motor cap base plate 46. First and second alignment flange portions 60 and 62 project above first and second lower lips 54 and 56, adjacent opposed surfaces of motor cap 20 defining tube slot or opening 70 to maintain the attenuation tube aligned therewithin. First and second upper lips 64 and 66 extend outward from body 52, above and in pressure contact with an inside surface of motor cap 20, specifically a top or inside surface of base plate 46.

A selected one of first and second upper lips 64 and 66 extends outward from front, flexible body section 84. In addition, at least a selected one of first and second upper lips 64 and 66 includes bottom section 92 and top section 94. Bottom section 92 extends outward from body 52, in pressure contact with the inside surface of motor cap 20, and defines a beveled surface 96 sloping upward and outward—that is, simultaneously outward away from body 52 and upward away from the adjacent surface of the motor cap. Beveled surface 96 facilitates outward swinging or flexing movement of bottom section 92 above and into pressure contact with the inside surface of motor cap 20. The upward sloping beveled surface 96 also allows for some tolerance in the thickness of the portion of motor cap 20 in pressure contact with attenuation tube 22. Top section 94 extends outward from body 52 and upward from bottom section 92, and defines beveled surface 100 sloping upward and inward—that is, simultaneously upward away from the bottom section and inward toward body 52. As will be explained in greater detail below, beveled surface 100 facilitates inserting attenuation tube 22 into tube opening 70.

With the preferred embodiment of attenuation tube 22 illustrated in the drawings, attenuation tube body 52 further includes back side 102 and further defines a pair of spaced, back slits or grooves 104 extending downward from a top of the back side to form a back, flexible body section 106; that is, a section which may be flexed or bent slightly relative to adjacent portions of the attenuation tube body. Also, first upper lip 64 extends outward from front, flexible body section 84, and second upper lip 66 extends outward from back flexible body section 106. Further, top section 94 preferably includes lower portion 110 defining a substantially vertical surface extending between surfaces 96 and 100. Lower portion 110 of top section 94 defines the outward-most projection of the top section away from body 52 and, thus, limits the extent to which the top section must deflect in order to move past the surfaces defining tube opening 70.

Preferably the above-discussed bottom and top sections 92 and 94 are front lip bottom and front lip top sections, extending outward from front upper lip 64, and back upper lip 66 includes back lip bottom and back lip top sections 112 and 114 substantially identical to the front lip bottom and top sections. Specifically, back lip bottom section 112 extends outward from back, flexible body section 106, in pressure contact with the inside surface of motor cap 20, and defines beveled surface 116 sloping upward and outward to facilitate moving the back lip bottom section into pressure contact with the inside surface of the motor cap. Back lip top section 114 extends outward from back, flexible body section 106 and upward from back lip bottom section 112, and defines beveled surface 120 sloping upward and inward to assist inserting attenuation tube 22 into tube opening 70.

Preferably attenuation tube body 52 gradually tapers inward from the bottom thereof to the top of the body. With this taper, attenuation tube body 52, in comparison to a tube body having a uniform cross sectional area, conducts vapor flow more smoothly from the interior of shell 16 to the interior of motor cap 20, reducing turbulence in the attenuation tube and, consequently, reducing pressure losses therein. Also, attenuation tube body 52 includes left and right sides 122 and 124, first and second lower lips 54 and 56 extend outward from these left and right sides respectively, and first and second alignment flange portions 60 and 62 extend upward from the first and second lower lips respectively.

Motor 14 is connected to an external source of electric energy via terminal block 126 and electric lead wires 130. Block 126 extends through shell 16; and wires 130 extend from the terminal block, through attenuation tube 22 and over an inside edge 132 thereof, through motor cap 20, and to motor 14. With this arrangement, preferably edge 132 is curved or rounded, reducing the friction between attenuation tube 22 and the portions of wires 130 passing thereover. Among other things, this prevents attenuation tube body 52 from scraping away the insulating covers of wires 130. Preferably, curved edge 132 is located at the top of at least one of the flexible body sections 84 and 106, and ideally both flexible body sections are provided with curved, top edges, eliminating the need to position a specific flexible body section on the side of hole 70 adjacent motor 14.

While the procedure for connecting attenuation tube 22 to and disconnecting the attenuation tube from motor cap 20 will be apparent from the above discussion, these procedures will now be described in detail. Attenuation tube 22 may be connected to motor cap 20 simply by locating the tube below the motor cap, aligned with tube slot opening 70 and with the longitudinal axis of the attenuation tube generally perpendicular or orthogonal to the surface of the motor cap defining opening 70, and then pushing the attenuation tube upward. As beveled surfaces 100 and 120 contact the surfaces of motor cap 20 defining tube slot 70, these motor cap surfaces push beveled surfaces 100 and 120 and, thus, upper lips 64 and 66 inward.

Once top sections 94 and 114 of upper lips 64 and 66 are pushed through tube opening 70, the inherent resiliency of the plastic material forming attenuation tube 22 urges the upper lips outward, over the inside surface of motor cap 20. Attenuation tube 22 is pushed upward until lower lips 54 and 56 are pressed into contact with the outside surface of motor cap 20; and the dimensions of the attenuation tube, specifically the relative position of the upper and lower lips thereof, are chosen so that as the lower lips are brought into pressure contact with the outside surface of the motor cap, the upper lips are in pressure contact with the inside surface of the motor cap, and the attenuation tube is securely connected thereto.

Alternately, and especially if attenuation tube 22 comprises only one flexible body section and only one of the upper lips 64 and 66 includes a bottom section 92 and a top section 94, the attenuation tube may be connected to motor cap 20 by positioning the attenuation tube below tube opening 70, tilting the attenuation tube away from a position orthogonal to the surfaces of motor cap 20 defining opening 70, and then pushing one upper lip through the attenuation tube opening. The attenuation tube is then straightened, pushing the other upper lip through tube opening 70 and bringing the upper and lower lips into pressure contact with, respectively, the inside and outside surfaces of motor cap 20.

It should be pointed out that, with both of the procedures outlined above, beveled surfaces 96 and 116 facilitate moving upper lips 64 and 66 over the inside surface of motor cap 20 by preventing the upper lips from binding against the inside surface of the motor cap as the upper lips move thereover, and by allowing for some tolerance in the thickness of the portion of the motor cap engaging the attenuation tube. Furthermore, frictional engagement between attenuation tube 22 and motor cap 20 may be reduced by manually pushing the flexible body section or sections of the attenuation tube inward slightly as the attenuation tube is pushed into tube opening 70. In addition, regardless of exactly how attenuation tube 22 is connected to motor cap 20, preferably when the attenuation tube is securely connected to the motor cap, as is believed best illustrated in FIG. 2, the various portions of attenuation tube body 52 are all in an essentially unflexed, or unstressed, position.

Thus, attenuation tube 22 is securely held in position without significant stress on the attenuation tube itself.

To disconnect attenuation tube 22 from motor cap 20, the flexible body section or sections of the tube are pushed inward and then the attenuation tube is pulled downward. Tilting attenuation tube 22 from its orthogonal orientation relative to the surfaces of motor cap 20 defining opening 70 and pulling one upper lip at a time through the attenuation tube opening may facilitate disconnecting the attenuation tube from the motor cap, particularly if the attenuation tube is provided with only one flexible body section.

Thus, as will be understood from a review of the above remarks, attenuation tube 22 may be easily connected to and disconnected from motor cap 20, and this may all be done from the outside thereof; that is, without requiring that a worker have access to the inside of the motor cap. The attenuation tube may be, and preferably is, formed from a plastic material such as Valox DR-51 which, in comparison to a metal material, has a lower cost and preferred thermal characteristics. Moreover, because attenuation tube 22 is formed from a plastic, for example via an injection molding process, providing the attenuation tube with a bottom to top inward taper requires minimal additional expense or time.

While it is apparent that the invention herein disclosed is well calculated to fulfill the objects stated above, it will be appreciated that numerous modifications and embodiments may be devised by those skilled in the art, and it is intended that the appended claims over all such modifications and embodiments as fall within the true spirit and scope of the present invention.

What is claimed is:

1. A motor compressor unit comprising:

a compressor;

a motor connected to the compressor to drive the compressor;

a shell enclosing the compressor and the motor;

a motor cap located within the shell, secured to and covering a portion of the motor, and defining an attenuation tube opening;

an attenuation tube connected to the motor cap, extending through the attenuation tube opening, and including a body having a front side and defining a pair of spaced, front slits extending downward from a top of the front side of the body to form a front, flexible body section, first and second lower lips extending outward from the body, below and in pressure contact with an outside surface of the motor cap, first and second alignment flange portions projecting above the first and second lower lips, adjacent opposed surfaces of the motor cap defining the attenuation tube opening to maintain the attenuation tube aligned therewithin, first and second upper lips extending outward from the body, above and in pressure contact with an inside surface of the motor cap, and wherein a selected one of the first and second upper lips extends outward from the front, flexible body section, and a selected one of the first and second upper lips includes a bottom section extending outward from the body, in pressure contact with the inside surface of the motor cap, and defining a beveled surface gradually sloping upward and outward to facilitate moving the bottom section into pressure contact with the inside surface of the motor cap, and a top section extending outward from the body and upward from the bottom section, and defining a beveled surface gradually sloping upward and inward to assist inserting the attenuation tube into the attenuation tube opening.

2. A motor compressor unit as defined by claim 1 wherein:

the body further includes a back side and further defines a pair of spaced, back slits extending downward from a top of the back side of the body to form a back, flexible body section;

the first upper lip extends outward from the front, flexible body section; and the second upper lip extends outward from the back, flexible body section.

3. A motor compressor unit as defined by claim 2 wherein the top section includes a lower portion defining a substantially vertical surface extending between the beveled surfaces defined by the top and bottom sections.

4. A motor compressor unit as defined by claim 2 wherein:

said bottom section is a front lip bottom section;

said top section is a front lip top section;

the first upper lip includes the front lip bottom section and the front lip top section; and the second upper lip includes a back lip bottom section extending outward from the back, flexible body section, in pressure contact with the inside surface of the motor cap, and defining a beveled surface sloping upward and outward to facilitate moving the back lip bottom section into pressure contact with the inside surface of the motor cap, and a back lip top section extending outward from the back, flexible body section and upward from the back lip bottom section, and defining a beveled surface sloping upward and inward to assist inserting the attenuation tube into the attenuation tube opening.

5. A motor compressor unit as defined by claim 2 further including an electric lead wire extending through the attenuation tube to connect the motor to an electric energy source; and wherein the body defines a curved, top edge to reduce friction between the body and the electric lead wire.

6. A motor compressor unit as defined by claims 3, 4 or 5 wherein the body tapers inward from a bottom thereof to the top of the body.

7. A motor compressor unit as defined by claim 6 wherein:

the body further includes left and right sides;

the first lower lips extends outward from the left side of the body;

the first alignment flange portion extends upward from the first lower lip;

the second lower lip extends outward from the right side of the body; and the second alignment flange portion extends upward from the second lower lip.

* * * * *